US006887067B2

(12) United States Patent
Griffin et al.

(10) Patent No.: US 6,887,067 B2
(45) Date of Patent: May 3, 2005

(54) CATALYTICALLY OPERATING BURNER

(75) Inventors: Timothy Griffin, Ennetbaden (CH); Peter Jansohn, Kuessaberg (DE); Verena Schmidt, Baden (CH); Dieter Winkler, Lauchringen (DE)

(73) Assignee: Alstom Technology LTD, Baden (CH)

( * ) Notice: Subject to any disclaimer, the term of this patent is extended or adjusted under 35 U.S.C. 154(b) by 0 days.

(21) Appl. No.: 09/843,836

(22) Filed: Apr. 30, 2001

(65) Prior Publication Data

US 2002/0155403 A1 Oct. 24, 2002

(30) Foreign Application Priority Data

Apr. 18, 2001 (DE) ..... 101 19 035

(51) Int. Cl.[7] ..... F23D 21/00

(52) U.S. Cl. ..... 431/7; 431/9; 431/350; 60/723

(58) Field of Search ..... 431/7, 9, 170, 431/326, 350, 328, 268; 422/180, 169, 170, 171, 174, 176, 177; 55/DIG. 30; 60/299, 300, 723; 502/439, 527.18

(56) References Cited

U.S. PATENT DOCUMENTS

| | | | | | |
|---|---|---|---|---|---|
| 2,490,079 | A | * | 12/1949 | Melvill | 261/94 |
| 2,526,657 | A | * | 10/1950 | Guyer | 422/197 |
| 3,492,098 | A | * | 1/1970 | De Palma et al. | 422/171 |
| 3,773,894 | A | * | 11/1973 | Berstein et al. | 423/213.5 |
| 3,785,781 | A | * | 1/1974 | Hervert et al. | 422/171 |
| 3,819,334 | A | * | 6/1974 | Yoshida et al. | 242/337.1 |
| 3,928,691 | A | * | 12/1975 | Knudson | 428/53 |
| 4,032,310 | A | * | 6/1977 | Ignoffo | 422/170 |
| 4,072,007 | A | | 2/1978 | Sanday | |
| 4,154,568 | A | * | 5/1979 | Kendall et al. | 431/7 |
| 4,330,436 | A | * | 5/1982 | Cairns et al. | 502/314 |
| 4,455,281 | A | * | 6/1984 | Ishida et al. | 422/171 |
| 4,530,418 | A | * | 7/1985 | Currie | 181/227 |
| 4,647,435 | A | * | 3/1987 | Nonnenmann | 422/180 |
| 4,672,809 | A | * | 6/1987 | Cornelison et al. | 60/286 |
| 4,676,934 | A | * | 6/1987 | Seah | 261/112.2 |
| 4,719,090 | A | * | 1/1988 | Masaki | 422/310 |
| 4,731,229 | A | * | 3/1988 | Sperandio | 422/188 |
| 4,753,918 | A | * | 6/1988 | Cyron | 502/439 |
| 4,870,824 | A | | 10/1989 | Young et al. | |
| 4,882,130 | A | * | 11/1989 | Asai et al. | 422/310 |
| 4,920,746 | A | * | 5/1990 | Gebelius | 60/299 |
| 4,928,485 | A | * | 5/1990 | Whittenberger | 60/299 |
| 5,003,768 | A | * | 4/1991 | Kappler et al. | 60/39.23 |
| 5,026,273 | A | * | 6/1991 | Cornelison | 431/170 |
| 5,130,208 | A | * | 7/1992 | Maus et al. | 428/593 |

(Continued)

FOREIGN PATENT DOCUMENTS

| | | | | |
|---|---|---|---|---|
| DE | 196 12 430 A1 | | 10/1996 | |
| DE | 195 27 583 A1 | | 1/1997 | |
| DE | 195 44 683 A1 | | 6/1997 | |
| EP | 0 577 117 | * | 1/1993 | 431/7 |
| EP | 1 179 709 A2 | | 2/2002 | |
| JP | 57-150443 | * | 9/1982 | |
| WO | 99/34911 | | 7/1999 | |
| WO | 99/62629 | | 12/1999 | |

*Primary Examiner*—Carl D. Price
(74) *Attorney, Agent, or Firm*—Burns, Doane, Swecker & Mathis, L.L.P.

(57) ABSTRACT

A catalytically operating burner with a catalyzer structure (4), useful in particular for a gas turbine system, has a heat-resistant carrier material (10) that forms the walls of several adjoining channels (13). The channels (13) pervade the catalyzer structure (4) in longitudinal direction and permit that a gaseous reaction mixture flows through the catalyzer structure (4). The walls are coated at least in part with a catalyst. In order to improve the catalytic conversion within the catalyzer structure (4), communicating openings (14) are constructed in the walls between an inlet end and an outlet end of the catalyzer structure (4). Adjoining channels (13) are able to communicate with each other through the communicating openings (14).

26 Claims, 4 Drawing Sheets

U.S. PATENT DOCUMENTS 5,162,288 A * 11/1992 Stringaro ..... 502/439
5,202,303 A * 4/1993 Retallick et al. ..... 502/439
5,228,847 A 7/1993 Lywood et al.
5,248,251 A 9/1993 Dalla Betta et al.
5,312,694 A * 5/1994 Sugawara ..... 428/592
5,328,359 A * 7/1994 Retallick ..... 431/326
5,346,389 A 9/1994 Retallick et al.
5,384,100 A * 1/1995 Freund ..... 422/180
5,403,559 A * 4/1995 Swars ..... 422/180
5,406,704 A * 4/1995 Retallick ..... 29/890
5,437,099 A 8/1995 Retallick et al.
5,460,002 A 10/1995 Correa
5,512,250 A 4/1996 Betta et al.
5,514,347 A * 5/1996 Ohashi et al. ..... 422/174
5,540,899 A * 7/1996 Koves ..... 422/200
5,552,360 A * 9/1996 Farrauto et al. ..... 502/178
5,591,413 A * 1/1997 Toyoda ..... 422/180
5,622,041 A 4/1997 Feeley et al.
5,623,819 A * 4/1997 Bowker et al. ..... 60/776
5,628,181 A * 5/1997 Kraemer ..... 60/39.11
5,658,536 A * 8/1997 Okabe et al. ..... 422/180
5,820,832 A * 10/1998 Huttenhofer et al. ..... 422/171
5,850,731 A 12/1998 Beebe et al.
5,916,128 A * 6/1999 Garr et al. ..... 60/274
6,015,285 A 1/2000 McCarty et al.
6,116,014 A * 9/2000 Dalla Betta et al. ..... 60/777
6,174,159 B1 1/2001 Smith et al.
6,179,608 B1 * 1/2001 Kraemer et al. ..... 431/9
6,190,784 B1 * 2/2001 Maus et al. ..... 428/593
6,277,340 B1 * 8/2001 Paikert et al. ..... 422/211
6,287,523 B1 * 9/2001 Hirohashi et al. ..... 422/180
6,497,098 B2 * 12/2002 Griffin et al. ..... 60/649
6,663,379 B2 * 12/2002 Schmidt et al. ..... 431/7
6,534,022 B1 * 3/2003 Carlborg et al. ..... 422/180
6,638,055 B2 * 10/2003 Carroni et al. ..... 431/9
6,667,017 B2 * 12/2003 Murrell et al. ..... 423/210

* cited by examiner

CATALYTICALLY OPERATING BURNER

This application is related and claims priority under 35 U.S.C. § 119 to German Patent Application Number 10119035.2, filed Apr. 18, 2001, entitled "Kalalytisch arbeitender Brenner", by Timothy Griffin, Peter Jansohn, Verena Schmidt, and Dieter Winkler, the entire contents of which are incorporated by reference herein.

FIELD OF THE INVENTION

The invention relates to a catalytically operating burner.

BRIEF DESCRIPTION OF THE RELATED ART

U.S. Pat. No. 5,512,250 describes a catalyzer structure provided with a heat-resistant carrier material that forms the common walls of a plurality of adjoining channels. These channels pervade the catalyzer structure longitudinally and permit a gaseous reaction mixture to flow through the catalyzer structure. The walls are coated at least in part with a catalyst. In the known catalyzer structure, several channels are at least partially coated on their inside walls with the catalyst, while other channels are not coated with the catalyst anywhere. This creates channels with parallel flows, of which some are catalytically active; the others are catalytically inactive or inert. Since no combustion reaction takes place in inert channels, they are used for cooling the active channels in order to prevent overheating of the overall catalyzer structure.

U.S. Pat. No. 5,248,251 describes a catalyzer structure whose carrier material is coated with a catalyst in such a way that a gradient for the reactivity of the catalyzer structure is obtained in flow direction. This reactivity gradient is hereby made up in such a way that the catalyzer structure has the highest activity at the inlet, and the lowest activity at its outlet, whereby the activity is reduced continuously or incrementally in flow direction. The high catalytic activity at the inlet of the catalyzer structure makes it possible for the ignition temperature for the charged reaction mixture to be reduced, resulting in reduced expenditure for measures to increase the temperature of the reaction mixture upstream from the catalyzer structure. The reactivity gradient makes it possible to prevent temperature spikes in the catalyzer structure. The carrier material used in the catalyzer structure is a metallic or ceramic monolith.

U.S. Pat. No. 6,015,285 describes a catalyzer structure in which a diffusion barrier layer is applied to the catalyzer layer that is coating the carrier material in order to specifically reduce the catalytic effect of the catalyst. This measure also is intended to prevent overheating of the catalyzer structure, in particular overheating generated when the catalytic reaction is sufficient to initiate a homogeneous gas phase reaction within the catalyzer structure.

U.S. Pat. No. 5,850,731 describes a burner for a gas turbine with a conventional first combustion zone followed by a catalytic second combustion zone followed by a conventional third combustion zone. In the case of intermediate loads of the burner, fuel is mixed into the waste gases of the conventional first combustion zone upstream from the catalytic second combustion zone, in order to increase the performance of the burner.

WO 99/34911 describes a structured packing unit used in systems for fluid contacting. Such systems are, for example, a distillation tower or a simple or multiple mixer. The packing unit can be constructed catalytically for use in a catalytic distillation device. The packing unit is constructed of sheet metal material bent at a right angle and is provided with a plurality of linear channels extending parallel to each other and having a rectangular, in particular square cross-section. Inside the channels, turbulence generators or turbulators that bring about a whirling of the flow are provided. These vortex generators form openings between adjoining channels and in this way enable a fluidic communicating between the channels. This also brings about a mixing of the streams between adjoining channels. In a special embodiment of this packing unit, the channels may be formed of a porous material of metallic fibers (woven fiber material) and coated with a catalyst. The woven fiber material provides the catalyzer layer with a very large surface, increasing its activity. The integration of a catalyst into the packing unit makes it possible, for example, after distillation or mixing of the individual fluids, in particular a fluid and a gas, that a chemical reaction can take place or be initiated in the mixture.

WO 99/62629 describes a further structured packing unit, in which the channels are formed from a porous material, whereby this porous material is provided with turbulators or turbulence generators that essentially permit a fluid flow through the pores of the porous material along the entire surface of the packing unit.

Catalytically operating burners with a catalyzer structure are used, for example, when burning fossil fuels, for example methane gas, in particular to achieve minimal NOx emissions. Catalytically operating burners hereby can be part of a gas turbine system and function there to generate hot combustion waste gases used to supply a turbine for driving a generator.

The main problems with this type of catalytic combustion are, on the one hand, the relatively high ignition temperature of the gaseous reaction mixture, for example, a fuel/air mixture. To achieve this high ignition temperature, a catalyst with high activity can be provided in the inlet area of the catalyzer structure. Alternatively, the temperature of the reaction mixture upstream from the catalyzer structure can be increased, for example, with an auxiliary burner. On the other hand, there is the risk of an overheating of the catalyzer structure, particularly if a homogeneous gas phase reaction forms still within the catalyzer structure. A "homogeneous gas phase reaction" here naturally means the automatically occurring combustion reaction of the reaction mixture that no longer needs a catalyst to occur. Another problem in the operation of a catalytically operating burner is that within a so-called "final combustion zone" downstream from the catalyzer structure only inadequate turbulence is present in the reaction mixture stream; this means that adequate combustion and minimal CO emissions within an appropriate dwell time in this final combustion zone can be realized only if this final combustion zone is relative large or long. Other problems may occur because the catalytic reactions or conversions take place differently in the different channels of the catalyzer structure so that no homogeneous reaction state is present along the flow cross-section in the outflowing mixture at the outlet of the catalyzer structure.

SUMMARY OF THE INVENTION

A goal of this invention is to remedy the aforementioned deficiencies. The invention relates to the objective of providing an embodiment of a catalytically operating burner of the initially mentioned type that permits improved catalytic combustion.

The invention is based on the general idea of connecting adjoining channels of the catalyzer structure with each other by means of communicating openings so that a flow exchange between these channels is made possible. This measure permits a mixing of the gas streams of the individual channels and has the result that the different reaction states that may potentially form within the channels compensate each other over the cross-section of the catalyzer structure, so that a relatively homogeneous reaction state exists over the entire cross-section of the stream. This improvement allows a shorter construction of a final combustion zone that follows the catalyzer structure.

In a further development of the burner, flow guidance means, which redirect at least part of the flow in one channel into an adjoining channel that is communicating with the former channel via the communicating opening, can be associated with at least one of the communicating openings. These flow guidance means in this way support the flow exchange between the channels connected with each other via the communicating opening.

In another embodiment, a turbulator may be provided near at least one of the communicating openings. Such a turbulator stimulates a stream coming in contact with it to generate vortices, so that turbulences form in the stream downstream from the turbulators. In this way, the flow direction of the reaction mixture receives directional components oriented transversely to the longitudinal direction of the catalyzer structure, or, respectively, transversely to the longitudinal extension of the channels. This supports a stream exchange between the channels through the communicating openings.

The flow guidance means of the communicating openings preferably may be constructed as turbulators.

A stream exchange through the communicating openings also can be improved in that the channels form at least in part a winding flow path through the catalyzer structure.

According to yet another embodiment, the walls may have been coated with the catalyst in such a way that some of the channels are catalytically active while other channels are catalytically inactive or inert. This measure prevents overheating of the catalytically active walls.

It is especially advantageous that the walls are coated with the catalyst in such a way that at least some of the channels have at least one catalytically active zone and at least one catalytically inactive or inert zone in flow direction. This measure makes it possible, for example, to control the reaction state of the reaction mixture, for example a fuel/air mixture, along the catalyzer structure. Because of this, the combustion reaction is able to reach a higher degree of efficiency.

A special embodiment is obtained by coating the walls with the catalyst in such a way that at least some of the channels have several active zones with differently designed catalytic activities in flow direction. This measure also enables a targeted adjustment of the desired reaction states along the catalyst structure.

According to a special embodiment, at least part of the carrier material coated with the catalyst may consist of a porous material. In this embodiment, the catalyst has a relatively large surface area and therefore can be made especially active. As a result, the ignition temperature of the reaction mixture decreases. It is also hereby possible to design the pores of the porous material so that these pores function as communicating openings between adjoining channels.

Especially high catalytic activity can be achieved if at least part of the carrier material coated with the catalyst consists of a woven fiber material. Such a woven fiber material has an especially large surface area that, when equipped with the catalyst, results in a low ignition temperature for the reaction mixture. Embodiments of such a woven fiber material are described, for example, in the above-mentioned WO 99/62629 document, which is incorporated by reference herein.

A special advantage of a carrier material made from a woven fiber material is the combination of low heat storage capability in connection with good thermal conductivity. Because of these characteristics, a uniform temperature distribution takes place that avoids temperature spikes, for example. Similar advantages can be achieved when a relatively thin metal foil is used as a carrier metal rather than a woven fiber material.

So that no homogeneous gas phase reaction develops within the catalyzer structure, the dwell time of the reaction mixture in the catalyzer structure must not exceed a maximum value. This means that on average a specific flow speed, which is derived from the pressure loss during the flowing through the catalyzer structure, must be present. In order to influence this pressure loss, the turbulators provided in the channels of a further development of the invention can be distributed along the catalyzer structure in such a way that the catalyzer structure is provided in flow direction with at least one zone equipped with the turbulators as well as with one zone not equipped with the turbulators.

Preferably, at least one of the zones equipped with the turbulators should have the outlet end of the catalyzer structure. This measure ensures that an intensive mixing of the partial streams exiting from the individual channels is achieved at the outlet of the catalyzer structure, i.e., at the transition into the final combustion zone of the burner. This intensive mixing supports the development of the homogenous gas phase reaction and reduces the flow speed, resulting in an increase in the dwell time inside the final combustion zone. This is desirable for achieving a short design of the final combustion zone.

The zone of the catalyzer structure with the outlet end preferably is constructed catalytically inactive or inert in order to avoid overheating of the catalyzer structure at this point.

In one further development, one of the zones, of which there is at least one, equipped with the turbulators should have the inlet end of the catalyzer structure in order to support a mixing of the channel streams immediately at the beginning of the catalyzer structure. Hereby an embodiment in which this zone is constructed catalytically inactive or inert is preferred. Because of this, this initial zone of the catalyzer structure functions like a static mixer for the intense mixing of the individual components of the reaction mixture, for example, fuel and air.

Accordingly, a standard static mixer is either no longer necessary or can be constructed smaller for the burner according to the invention.

According to a preferred variation of the burner according to the invention, one zone of the catalyzer structure that contains the inlet end can be equipped with turbulators and constructed catalytically inactive or inert, whereby in an area between the inlet end and outlet end of the catalyzer structure at least one catalytically active zone is constructed, and whereby one zone of the catalyzer structure containing the outlet end is equipped with turbulators and is constructed catalytically inactive or inert. This combination of characteristics creates a homogeneous reaction mixture in the inlet zone, whereby the inlet zone here also functions as a static mixer. Downstream from this inlet zone, the catalytic reaction then takes place in order to start the combustion of the mixture in a targeted manner. An intense mixing of the already burning or reacting partial streams of the individual channels then again takes place in order to prepare the homogeneous gas phase reaction in the final combustion chamber. This makes it particularly clear that the catalyzer structure does not only have the actual catalyzer function but, in addition, has the function of a static mixer at the inlet and the function of a mixer or turbulator at the outlet in order to improve the homogeneous gas phase reaction in the final combustion chamber, so that the latter's design length can be reduced.

In another alternative embodiment of the burner according to the invention, a zone of the catalyzer structure containing the inlet end can be equipped with turbulators and constructed catalytically highly active, whereby in an area between the inlet end and outlet end of the catalyzer structure a zone constructed without turbulators is constructed catalytically active, whereby a zone of the catalyzer structure containing the outlet end is equipped with turbulators. In this embodiment, the combustion reaction of the entering reaction mixture is already started at the inlet, whereby the highly active catalyst enables low ignition temperatures. Since no turbulators are arranged in the area following downstream, a relatively low pressure loss results so that relatively high flow speeds are present. This measure reduces the risk that the homogeneous gas phase reaction still ignites inside the catalyzer structure. An intensive mixing of the exiting individual streams is again achieved here in the outlet zone in order to improve the creation of the homogenous gas phase reaction.

Aspects of the invention are based on the recognition that, given appropriate adaptations, especially with respect to material selection and catalyst selection, it is possible to use a structure as it is known in principle, for example from the above mentioned WO 99/62629 and WO 99/34911 documents, in a catalytically operating burner, in particular for a gas turbine system, as a catalyzer structure.

Other important characteristics and advantages of the invention may be gained from the secondary claims, drawings and associated description in reference to the drawings.

BRIEF DESCRIPTION OF DRAWINGS

Exemplary embodiments of the invention are shown in the drawings and described in more detail in the following description. The schematic drawings show in.

DETAILED DESCRIPTION OF PREFERRED EMBODIMENTS

Figure 1:
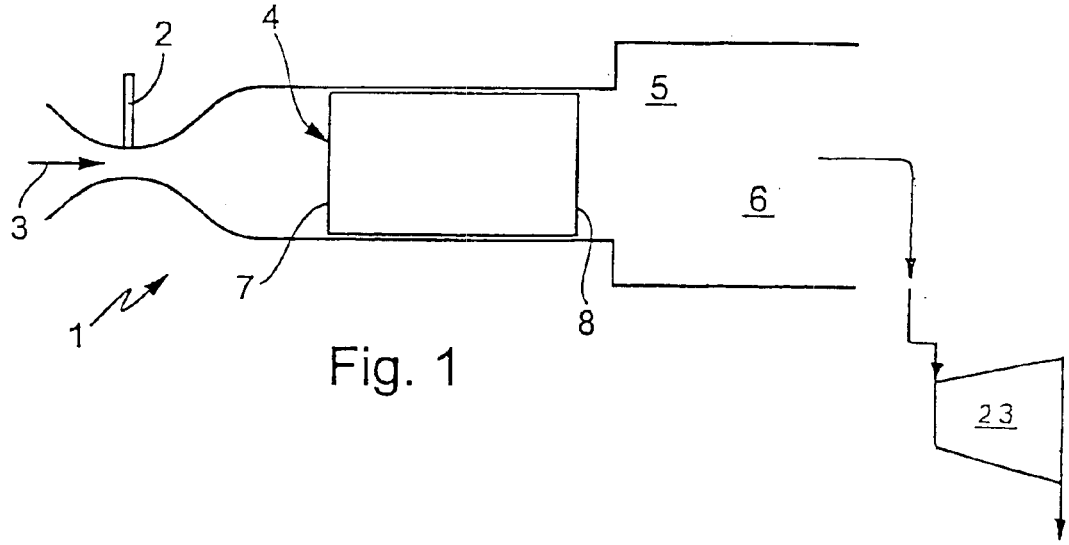
FIG. 1 illustrates a greatly simplified depiction of the principles of a first embodiment of a burner according to the invention.
Figure 2:
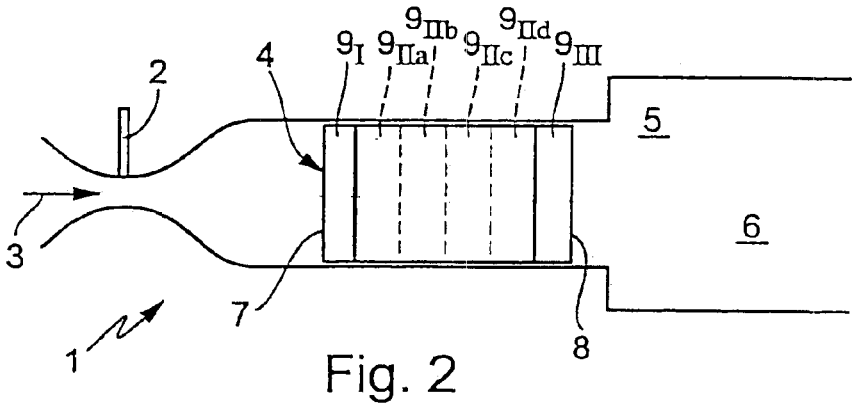
FIG. 2 illustrates a view as in FIG. 1, but for a second embodiment.
Figure 3:
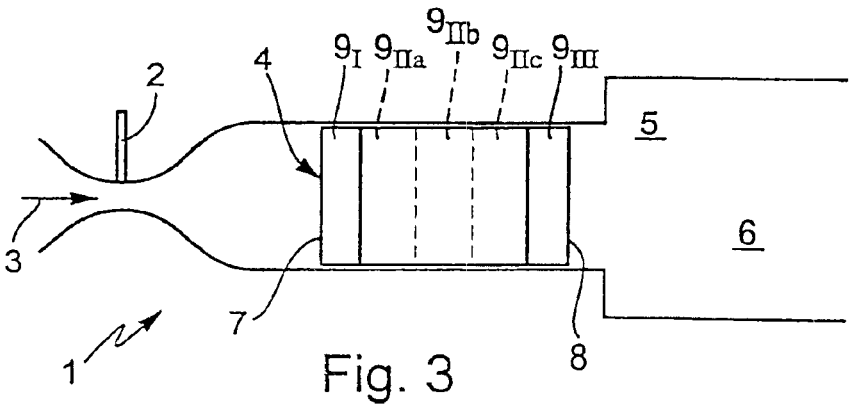
FIG. 3 illustrates a view as in FIG. 1, but for a third embodiment.

According to FIGS. 1 to 3, a burner 1 according to the invention has a fuel injection device 2 that injects fuel into a supplied gas stream 3 that contains an oxidant. The gas stream 3, symbolized here by an arrow, may consist, for example, of an air stream. Methane also can be injected as a fuel. The fuel injection device 2 may be constructed as a so-called "Venturi injector" here.

Downstream from the fuel injection device 2, the burner 1 contains a catalyzer structure 4 through which the fuel/gas mixture or reaction mixture can flow, whereby a catalyst that initiates a combustion reaction of the reaction mixture is provided inside the catalyzer structure 4. Downstream from the catalyzer structure 4, a stabilization zone 5, indicated here by an abrupt increase in the cross-section of the burner 1, is arranged in the burner 1. This stabilization zone 5 changes into a final combustion zone 6 in which the actual combustion reaction of the reaction mixture, i.e., the homogeneous gas phase reaction, takes place. If the burner 1 forms part of a gas turbine system (otherwise not shown here), the hot combustion gases generated in the final combustion zone 6 by the homogeneous gas phase reaction can be fed to a downstream turbine 23. Since the burner 1 initiates and/or stabilizes the combustion reaction by means of the catalyzer structure 4, the burner 1 operates catalytically.

The catalyzer structure 4 has an inlet end 7 and an outlet end 8, and according to FIGS. 2 and 3 can be divided or classified into several zones 9 that follow each other in flow direction. Hereby one inlet zone 9 comprises the inlet end 7, while an outlet zone $\mathbf{9}_{III}$ contains the outlet end 8. Between inlet end 7 and outlet end 8, an intermediate zone $\mathbf{9}_{II}$ is formed, which again may be divided into several partial zones $\mathbf{9}_{IIa}$ to $\mathbf{9}_{IIc}$ or $\mathbf{9}_{IId}$. Type and number of divisions is hereby given solely as an example and does not restrict any general application.

Figure 4:
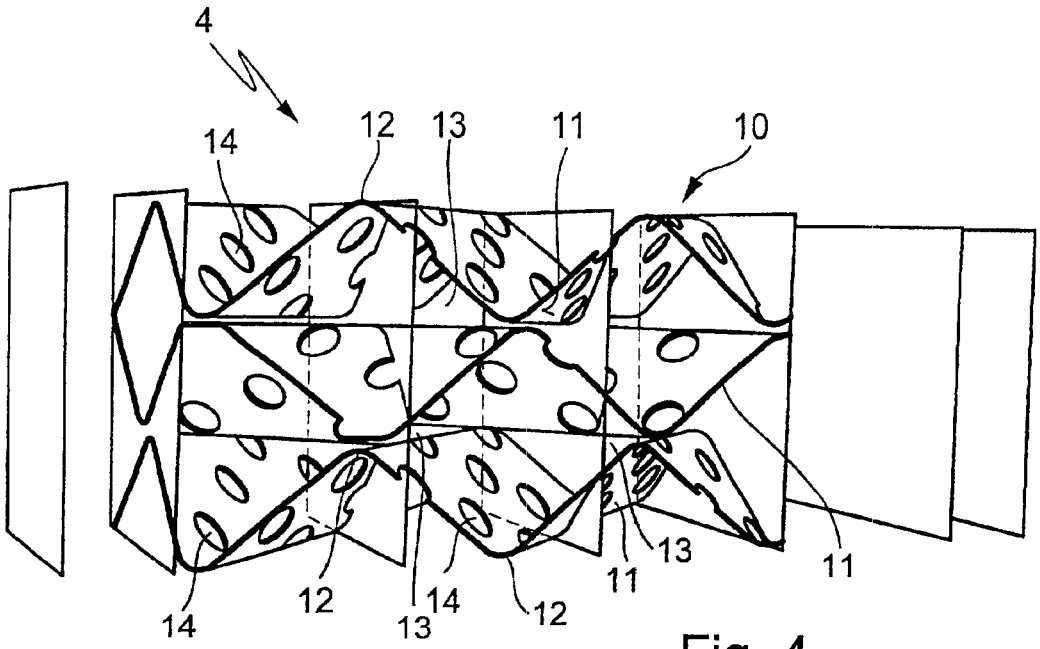
FIG. 4 illustrates a view of a section of a catalyzer structure according to the invention for a first embodiment.

FIG. 4 shows a section of the catalyzer structure 4, whereby the viewing direction extends parallel to a flow direction at which the reaction mixture enters the catalyzer structure 4. According to FIG. 4, a carrier material 10, of which the catalyzer structure 4 is constructed, consists of several layers of a material web 11. In the section shown in FIG. 4, three such layers of material webs 11 are shown. The material webs 11 here are each folded in a zigzag shape, whereby apex lines 12 of the individual folds of such material webs 11 that adjoin each other vertically and transversely to the flow direction, according to FIG. 4 vertically, are oriented in different ways. In FIG. 4, the apex lines 12 of the upper and lower material webs 11 are oriented so that they move away from a vertical axis towards the right in viewing direction. In contrast to this, the apex lines 12 of the middle material web 11 are oriented so that they move away from a vertical axis towards the left in viewing direction. The material webs 11 adjoining each other in the vertical axis are contacting each other at the intersecting apex lines 12. More or less winding channels 13 that permit a flow through the catalyzer structure 4 are formed between adjoining layers 11. The material webs 11 hereby form the walls of these channels 13.

According to the invention, communicating openings 14 through which the adjoining channels 13 communicate with each other are provided in these walls. This means that a mixing of the streams conducted in the individual channels 13 can take place through these communicating openings 14. Different degrees of conversion or different reaction states that may form in the different channels 13 are essentially compensated by the flow exchange between the channels 13. The winding flow paths through the catalyzer structure 4 created by the special design of the channels 13 hereby support the flow exchange through the communicating openings 14.

Figure 5:
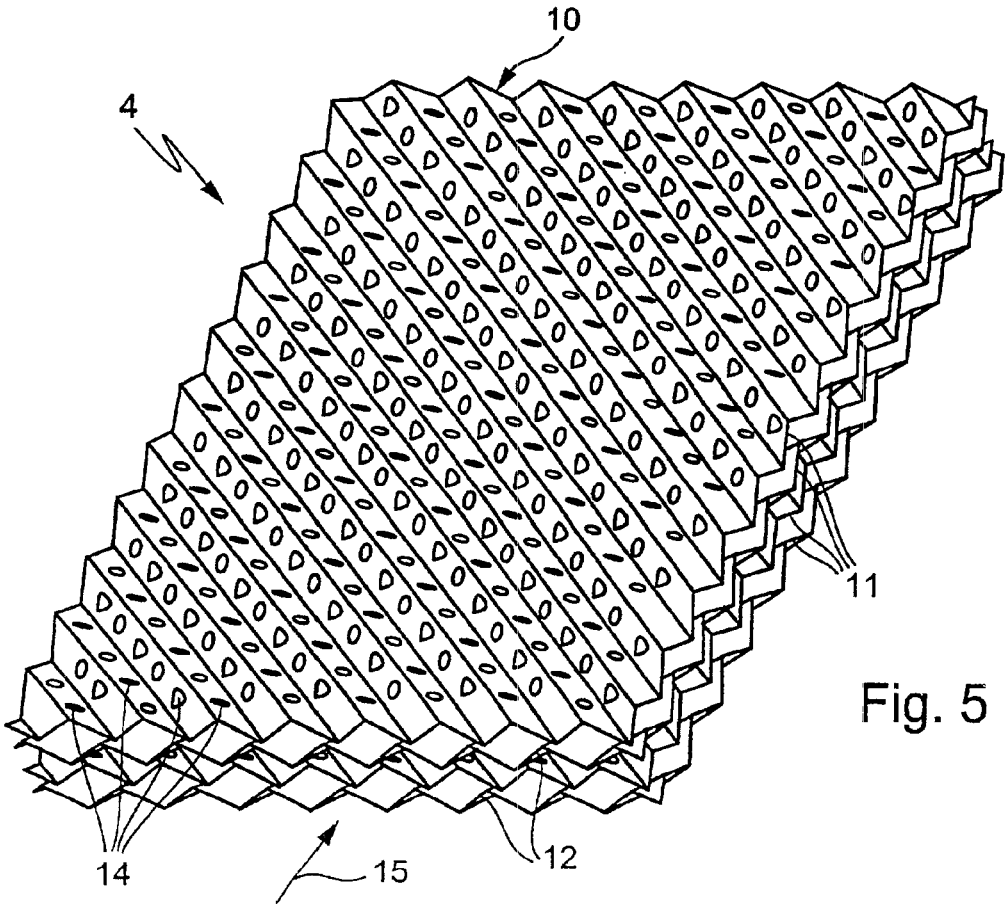
FIG. 5 illustrates a perspective view of a section of the catalyzer structure, but for a second embodiment.

FIG. 5 shows a larger section of the catalyzer structure 4 whose carrier material 10 also is constructed of several layers of the material webs 11. However, FIG. 5 only shows a section with four material webs 11. In FIG. 5, a flow direction 15, which in FIG. 4 coincides with the viewing direction, is indicated by an arrow. In the special embodiment shown here, the apex lines 12 intersect the flow direction 15 at an angle of approximately 45°. The adjacent apex lines 12 of adjoining material webs 11 then are approximately perpendicular to each other.

Instead of zigzag-folded material webs 11, material webs that have been folded or corrugated in triangle or rectangular shape also can be used for the layers.

Figure 6:
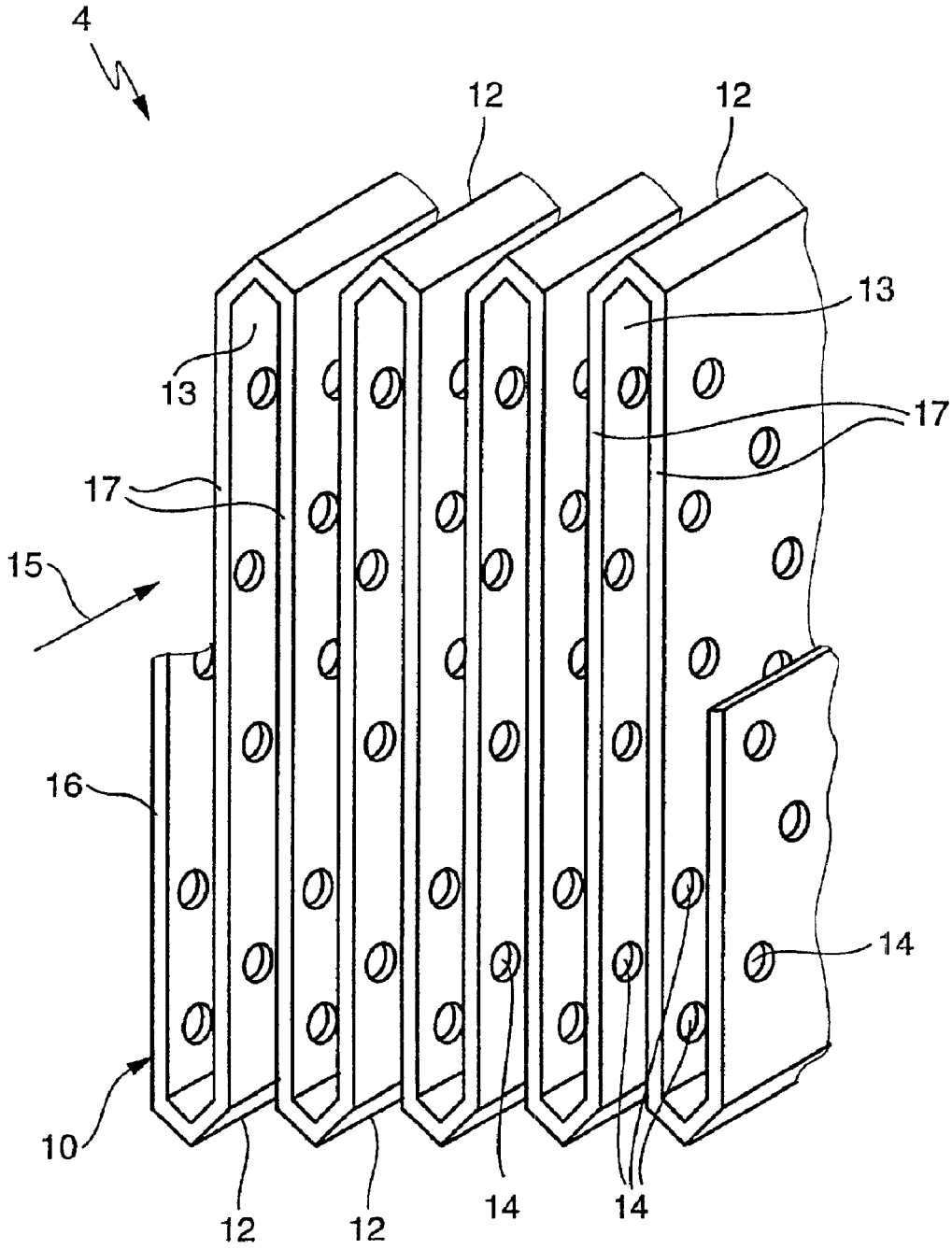
FIG. 6 illustrates a view as in FIG. 4, but for a third embodiment.

FIG. 6 also shows a section of the catalyzer structure 4, in which the carrier material 10, in contrast to the embodiments of FIGS. 4 and 5, does not consist of several material webs but of one material web 16 folded several times. The apex lines 12 of the folds of this material web 16 hereby can extend, for example, in the longitudinal direction of the catalyzer structure 4, in particular parallel to the flow direction 15. Between consecutive apex lines 12, the material web 16 has planar areas that form planar wall section 17 that extend parallel to each other. The channels 13 are formed between adjoining wall sections 17. The communicating openings 14 through which the adjoining channels 13 communicate with each other are constructed in these planar wall sections 17.

A woven fiber material based on metallic fibers may be used, for example, as a material for the material web 16 according to FIG. 6 or for the material webs 11 according to FIGS. 4 and 5; this woven fiber material is coated in the catalytically active sections with an appropriate catalyst. It is also possible to fashion the material webs 11 or 16 from a relatively thin metal foil. These materials are characterized by high thermal conductivity and low heat storage capability, since the combination of these characteristics results in a uniform temperature distribution within the catalyzer structure 4 and thus prevents temperature spikes as well as overheating and in particular the initiation of a homogeneous gas phase reaction within the catalyzer structure 4.

Figure 7:
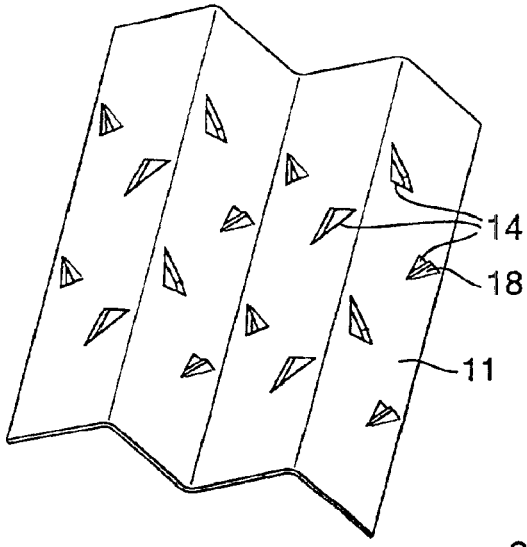
FIG. 7 illustrates a perspective view of a component of the catalyzer structure.

According to FIG. 7, the folded material webs 11 from which the individual layers of the carrier material 10 have been fashioned can be provided with flow guidance means, for example, in the form of triangular wings 18. Each wing 18 is hereby associated with one of the communicating openings 14. The wings 18, towards which the flow is directed appropriately, support a deflection of the flow from one channel through the communicating opening 14 into the adjoining channel. In the case at hand, the wings 18 simultaneously function as turbulators that stimulate the formation of vortices and thus turbulences in a stream that comes into contact with the wings 18.

In the embodiment according to FIG. 7, the communicating openings 14, the flow guidance means, and the turbulators in the form of the wings 18 can be produced in an especially simple manner, for example, with stamping processes. In this process, two triangle sides of each wing 18 are cut free so that the wing can be bent at the third side in such a way that the wing 18 projects into one of the channels. By bending the wings 18 away from the material web 11, triangular openings are created there that form the communicating openings 14.

Figure 8:
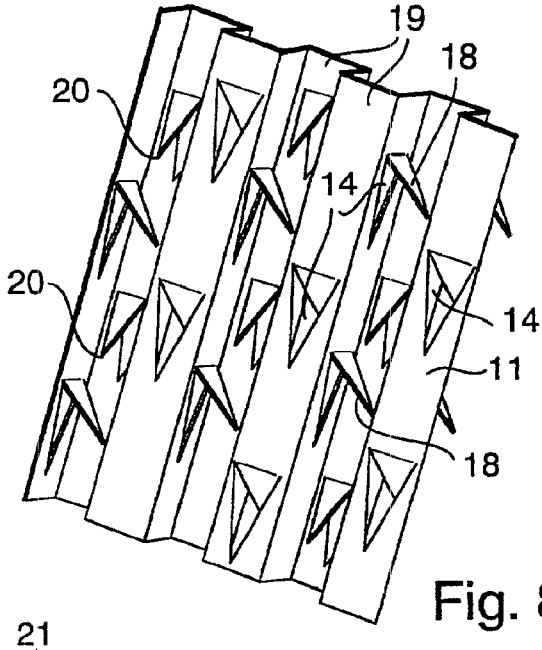
FIG. 8 illustrates a view as in FIG. 7, but for another embodiment.

In another embodiment, the layers are formed according to FIG. 8 by material webs 11 folded in rectangular waves that instead of apex lines have apex surfaces 19. The communicating openings 14 and wings 18 that function as flow guidance means and turbulators preferably are also produced here by a stamping process with cutting free and bending of the wings. However, in this special embodiment, the triangle side of the wing 18 at which the wing 18 is bent into shape extends approximately transversely to the extension direction of the apex surfaces 19 of the associated material web 11. In addition, one tip 20 of each wing 18 is pointed upstream, i.e., against the flow direction. The wings 18 also can project from the respective wall to such an extent that they come to rest against a parallel opposite wall.

Figure 9:
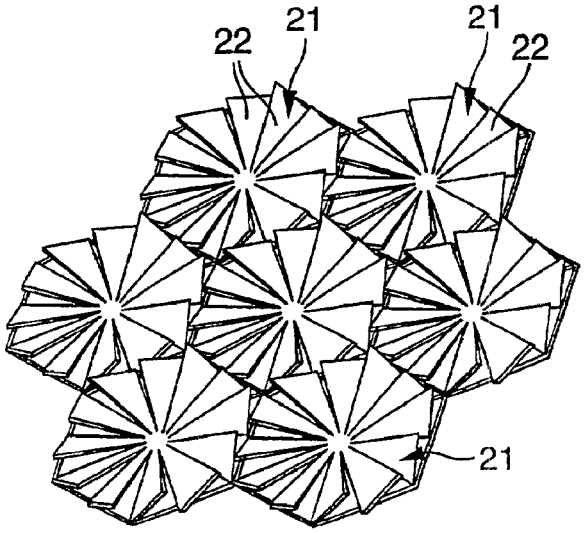
FIG. 9 illustrates a view as in FIG. 7, but for another embodiment.

FIG. 9 shows an arrangement of seven guide vane structures 21 that can be arranged transversely to a flow direction in each one of the channels. Such a guide vane structure 21 forces a stream flowing through it to rotate around an axis extending parallel to the flow direction. In the case at hand, the guide vane structures 21 have a hexagonal circumference, thus resulting in a corresponding honeycomb structure of the adjoining channels. Each of these guide vane structures 21 has several blades 22 placed outward at an angle towards the flow direction and oriented so that the desired rotation is created in the stream downstream from the guide vane structure 21.

In a first exemplary embodiment according to FIG. 1, the catalyzer structure 4 may consist, for example, completely of a woven fiber material that is coated with a catalyst. This construction permits a low thermal storage capability for the catalyst structure 4 and results in an advantageous ignition characteristic. This construction also ensures a favorable temperature transport and flow exchange between adjoining channels inside the catalyzer structure. Due to the surface quality of the woven material, the walls of the channels have a certain roughness that promotes the formation of vortices in the stream and therefore an intensive mixing. With a corresponding design of the catalyzer structure 4 formed in this way, an adequate vortex or turbulence of the stream can be achieved at the outlet end 8, so that the final combustion zone 6 can be constructed relatively small.

In a second embodiment according to FIG. 2, the inlet zone $\mathbf{9}_I$ is constructed catalytically inactive or inert and is equipped with turbulators (not shown here). Because of this measure, the inlet zone $\mathbf{9}_I$ acts as a static mixer that ensures homogeneous mixing of the gas stream 3 with the injected fuel. In the intermediate zone $\mathbf{9}_{II}$, the carrier material is coated with a catalyst. The individual partial zones $\mathbf{9}_{IIa}$ to $\mathbf{9}_{IId}$ hereby may differ from each other with respect to catalytic activity and/or flow characteristics (e.g., turbulator density). In this intermediate zone $\mathbf{9}_{II}$, the catalyst initiates the combustion reaction of the reaction mixture. By construction of the individual partial zones $\mathbf{9}_{IIa}$ to $\mathbf{9}_{IId}$, this catalytically active part of the catalyzer structure 4 is specifically constructed so that a lower ignition temperature is achieved, whereby, the development of a homogeneous gas phase reaction within the catalyzer structure 4 is still avoided. In particular, one or the other of the partial zones $\mathbf{9}_{IIa}$ to $\mathbf{9}_{IId}$ may be constructed catalytically inactive or inert. The outlet zone $\mathbf{9}_{III}$ in this embodiment is again constructed catalytically inactive or inert and is provided with turbulators in order to achieve an intensive mixing of the individual channel streams at outlet 8 of the catalyst structure 4. Here also, this intensive swirling has the result that the burner 1 requires only a final combustion zone 6 that is relatively short.

According to a third embodiment according to FIG. 3, the inlet zone $\mathbf{9}_I$ is designed so that between the adjoining channels a relatively intensive mixing that brings about a correspondingly intensive temperature compensation occurs. This can be realized in particular by means of correspondingly arranged turbulators. The inlet zone $9_I$ is furthermore designed catalytically highly active so that the inlet zone $9_I$ functions as an ignition zone. These characteristics of the inlet zone $9_I$ can be realized in a particularly simple manner by using a woven metallic fiber material coated with the highly active catalyst as a carrier material. The intermediate zone $9_{II}$ is also coated with a catalyst, whereby the intermediate zone $9_{II}$ is designed with respect to a minimal pressure decrease, so that the risk that a homogeneous gas phase reaction is ignited within the catalyzer structure 4 is reduced. The intermediate zone $9_{II}$, for example, can be divided into several partial zones $9_{IIa}$ to $9_{IIc}$ that differ from each other with respect to their catalytic activity. In particular, active and inert partial zones may follow each other. The outlet zone $9_{III}$ again has turbulators for generating intensive whirling and mixing at the outlet end 8 of the catalyzer structure 4. The outlet zone $9_{III}$ may be designed catalytically active or inactive. The intermediate zone $9_{II}$ and the outlet zone $9_{III}$ in this embodiment also can be produced from a porous woven fiber material; alternatively, a thin metal foil or ceramic carrier material also can be used.

While the invention has been described in detail with reference to preferred embodiments thereof, it will be apparent to one skilled in the art that various changes can be made, and equivalents employed, without departing from the scope of the invention. Each of the aforementioned published documents are incorporated by reference herein in its entirety.

LIST OF REFERENCE NUMBERS

1 Burner
2 Fuel injection device
3 Gas stream
4 Catalyzer structure
5 Stabilization zone
6 Final combustion zone
7 Inlet end of 4
8 Outlet end of 4
9 Zone of 4
$9_I$ Inlet zone
$9_{II}$ Intermediate zone
$9_{III}$ Outlet zone
10 Carrier material
11 Material web
12 Apex line
13 Channel
14 Communicating opening
15 Flow direction
16 Material web
17 Planar wall section
18 Wing
19 Apex surface
20 Triangle tip
21 Guide vane structure
22 Blade

What is claimed is:

1. A catalytically operating burner mounted in a gas turbine system, the burner comprising:

a fuel injection device that injects fuel into a supplied gas stream that contains an oxidant;

a catalyzer structure that is arranged downstream from the fuel injection device, and through which the gas stream with injected fuel can flow, whereby a catalyst that initiates a combustion reaction of the gas stream with injected fuel is provided inside the catalyzer structure, the catalyzer structure is divided into (i) an inlet zone including an inlet end of the catalyzer structure and which is catalytically inactive or inert, (ii) an outlet zone including an outlet end of the catalyzer structure and which is catalytically inactive or inert, and (iii) an intermediate zone which is catalytically active and located between the inlet zone and the outlet zone along a flow direction;

a stabilization zone that is arranged downstream from the catalyzer structure, and which changes into a final combustion zone in which the actual combustion reaction of the gas stream with injected fuel or a homogenous gas phase reaction takes place, wherein the hot combustion gases generated in the final combustion zone by the homogenous gas phase reaction are fed to a downstream turbine of the gas turbine system;

a heat-resistant carrier material that extends continuously from the inlet end to the outlet end of the catalyzer structure and that forms the walls of several adjoining channels that pervade the catalyzer structure in a longitudinal direction and permit the gas stream with injected fuel to flow through the catalyzer structure;

the walls being coated with the catalyst in such a way that at least some of the channels have at least one catalytically active zone and at least two catalytically inactive or inert zones in the flow direction;

communicating openings being constructed in the walls, through which the adjoining channels communicate with each other.

2. A burner as claimed in claim 1, further comprising flow guidance means for redirecting at least part of the flow in one channel into an adjoining channel that communicates with the one channel via the communicating openings, the flow guidance means being associated with at least one of the communicating openings.

3. A burner as claimed in claim 1, further comprising a turbulator associated with at least one of the communicating openings.

4. A burner as claimed in claim 2, wherein the flow guidance means are constructed as a turbulator.

5. A burner as claimed in claim 1, wherein the channels form at least in part a winding flow path through the catalyzer structure.

6. A burner as claimed in claim 1, wherein the walls are coated with the catalyst in such a way that at least some of the channels have several active zones with differently designed catalytic activities in the flow direction.

7. A burner as claimed in claim 1, wherein at least part of the carrier material coated with the catalyst comprises a porous material.

8. A burner as claimed in claim 1, wherein at least part of the carrier material coated with the catalyst comprises a woven fiber material.

9. A burner as claimed in claim 1, wherein at least part of the carrier material coated with the catalyst comprises a metal foil.

10. A burner as claimed in claim 1, further comprising turbulators in the channels, the turbulators being distributed in the channels along the catalyzer structure so that the catalyzer structure is provided in the flow direction with at least one zone equipped with the turbulators as well as with a turbulators-free zone.

11. A burner as claimed in claim 10, wherein one of the at least one zones equipped with the turbulators is the outlet zone of the catalyzer structure.

12. A burner as claimed in claim 10, wherein one of the at least one zones equipped with the turbulators is the inlet zone of the catalyzer structure.

13. A burner as claimed in claim 10, wherein the inlet zone and the outlet zone of the catalyzer structure are equipped with turbulators.

14. A burner as claimed in claim 10, wherein the inlet zone of the catalyzer structure is equipped with turbulators;

a turbulators-free zone is constructed catalytically active in an area between the inlet end and the outlet end of the catalyzer structure; and the outlet zone of the catalyzer structure is equipped with turbulators.

15. A burner as claimed in claim 1, wherein the carrier material comprises at least several layers, each layer being formed of a material web that has been at least one of folded and corrugated in zigzag or triangular or rectangular shape, the apex lines or apex surfaces of the folds, the waves, or both, in material webs that adjoin each other transversely to the flow direction are oriented differently, such that adjoining material webs rest against each other at the intersecting apex lines or apex surfaces and form channels between them.

16. A burner as claimed in claim 15, wherein the apex lines or apex surfaces are oriented at an angle to the longitudinal direction of the catalyzer structure.

17. A burner as claimed in claim 1, wherein the carrier material comprises a material web folded several times, wherein the apex lines or apex surfaces of the folds extend approximately in the longitudinal direction of the catalyzer structure, wherein planar wall sections are formed between consecutive apex lines or apex surfaces, wherein adjoining planar wall sections extend parallel to each other, and wherein the channels are formed between the adjoining wall sections.

18. A burner as claimed in claim 1, wherein flow guidance means, turbulators, or both, in the walls are formed by triangular wings, wherein two triangle sides of the wing are cut free and wherein the wing is bent on the third triangle side in such a way that the wing projects into one of the channels, wherein the triangular openings created hereby in the walls form the communicating openings.

19. A burner as claimed in claim 18, wherein the bent triangle side of the wing extends approximately transversely to the extension direction of the apex lines or apex surfaces of the material web, and that the triangle tip of the wing is pointed upstream.

20. A burner as claimed in claim 1, wherein at least one of the channels is provided along the catalyzer structure at at least one point with a guide vane structure that is oriented transversely to the flow direction and that forces a stream flowing through it to rotate around an axis extending parallel to the flow direction.

21. A burner as claimed in claim 1, wherein the intermediate zone is divided into a plurality of partial zones.

22. A burner as claimed in claim 21, wherein one of the partial zones is catalytically inactive or inert.

23. A gas turbine system, comprising:

a catalytically operating burner as claimed in claim 1; and a turbine downstream from the burner.

24. A process of using a catalyzer structure, comprising the steps of:

providing a catalyzer structure which is divided into (i) an inlet zone including an inlet end of the catalyzer structure and which is catalytically inactive or inert, (ii) an outlet zone including an outlet end of the catalyzer structure and which is catalytically inactive or inert, and (iii) an intermediate zone which is catalytically active and located between the inlet zone and the outlet zone along a flow direction, the catalyzer structure including a heat-resistant carrier material that extends continuously from the inlet end to the outlet end of the catalyzer structure and that forms the walls of several adjoining channels that pervade the catalyzer structure in the longitudinal direction of the catalyzer structure and enable a gas stream with injected fuel to flow through the catalyzer structure, wherein the walls are coated with a catalyst in such a way that at least some of the channels have at least one catalytically active zone and at least two catalytically inactive or inert zones in the flow direction and wherein between the inlet end and the outlet end of the catalyzer structure communicating openings are constructed in the walls, through which the adjoining channels are communicating with each other, in a catalytically operating burner; and flowing the gas stream with injected fuel through the catalyzer structure whereby the catalyst initiates a combustion reaction of the gas stream with injected fuel inside the catalyzer structure;

a stabilization zone being arranged downstream from the catalyzer structure, and which changes into a final combustion zone in which the actual combustion reaction of the gas stream with injected fuel or a homogenous gas phase reaction takes place, wherein the hot combustion gases generated in the final combustion zone by the homogenous gas phase reaction are fed to a downstream turbine of the gas turbine system.

25. A process as claimed in claim 24, wherein the intermediate zone is divided into a plurality of partial zones.

26. A process as claimed in claim 25, wherein one of the partial zones is catalytically inactive or inert.

* * * * *